US005555990A

United States Patent [19]

Bechstein

[11] Patent Number: 5,555,990

[45] Date of Patent: Sep. 17, 1996

[54] STOCK SUPPORT SYSTEM

[76] Inventor: Steven W. Bechstein, 819 Webster St., Fort Wayne, Ind. 46802

[21] Appl. No.: 254,520

[22] Filed: Jun. 6, 1994

[51] Int. Cl.[6] ..... A47F 5/00

[52] U.S. Cl. ..... 211/59.3; 211/184

[58] Field of Search ..... 211/184, 59.3, 211/43, 51

[56] References Cited

U.S. PATENT DOCUMENTS

| | | | |
|---|---|---|---|
| 1,621,410 | 3/1927 | House | 211/43 |
| 3,786,933 | 1/1974 | Vianzon | 211/184 X |
| 3,848,745 | 11/1974 | Smith | 211/59.3 |
| 4,410,093 | 10/1983 | Chiariello et al. | 211/184 X |
| 4,682,696 | 7/1987 | Sheu | 211/43 |
| 4,729,481 | 3/1988 | Hawkinson et al. | 211/59.3 |
| 4,830,201 | 5/1989 | Breslow | 211/59.3 X |
| 4,899,893 | 2/1990 | Robertson | 211/59.3 |

*Primary Examiner*—Robert W. Gibson, Jr.

*Attorney, Agent, or Firm*—Barnes & Thornburg

[57] ABSTRACT

An improved stock support system which is placed on existing frozen, refrigerated or dry display case shelving with the Support Base Handle facing the front of the retail display shelf. The Stock Support Panel is placed upright on the Support Base by inserting the insertion pins on the bottom of the Stock Support Panel into the corresponding holes on the Support Base providing the desired depth of the shelf space. Retail food products are then placed on top of the Support Base with the first item resting against the Support Base Handle. The Stock Support Panel is adjusted to the corresponding Stock Base holes which allow it to insert behind the last retail food package on the Support Base. As the product stock is depleted the Support Base can be lifted with the handle, pulled forward and angled down allowing remaining product to slide up against the Support Base Handle. The Stock Support Panel is then instered into holes behind the last package and the Support Base is returned to the shelf with all product now facing forward in the upright position.

11 Claims, 3 Drawing Sheets

STOCK SUPPORT SYSTEM

BACKGROUND OF THE INVENTION

1. Field of the Invention

The invention relates generally to a device for supporting retail food packages on existing retail display case shelves. Existing display shelves have little or no support at the front of the shelves and the only support to the back of the shelves would be the back wall of the display case making it necessary for the shelf to be full of product to effectively keep many styles of packaging from falling over. The device has an adjustable back panel to replace the permanent back wall of the case as a support mechanism, a front support to keep product from falling forward and a base for the back support panel to adjust on. The device is manually adjustable to keep the food packages in upright position, faced to the front of the shelves, for maximum customer exposure without falling over.

2. Description of the Prior Art

Stock supports currently consist of non adjustable trays designed for specific sized packages where packages fit into slots in the base and packages are brought to the front on the display shelf by manually realigning each package and moving them to the front slots, and are good for only that one specific product. Also available are trays designed for specific sized packages that have a spring loaded mechanism that pulls the back panel forward as packages are removed from the front of the base. Spring loaded type trays can be very clumsy and time consuming to refill and make it very difficult for the customer to replace a package if they change their mind and try to return the package back into the display tray or bin. Some existing devices are constructed of plastic having sharp edges, making them very uncomfortable on the hands of store personnel who, because of the volume of packages to be stocked, must work at a very fast pace subjecting their hands to injury from the sharp edges. This invention eliminates these problems since it adjusts manually and easily to most retail food packages. Its smooth contoured design and durable construction is not abusive on the store personnel hands.

SUMMARY OF THE INVENTION

The invention relates to a device which allows retail food stores to stock different size retail food packages to the front edge of display shelves in an upright position and to manually adjust food packages to the front of the shelves as product is depleted. The invention consists of a narrow base with a set of holes down each side, a front support handle, and a stock support panel with two insertion pins which secure the support panel into the desired holes to keep retail food packages to the front of the display case. The invention sets on existing wire or solid metal display shelves. Each specific retail food package would require its own stock support system. It would be at the discretion of the store personnel as to which individual retail food packages they wished to use the stock support system under or on.

The invention is designed, but not limited, for use on existing open or door style refrigerated, frozen, dry food, and non food store retail packages. Designed for display case shelves of up to but not limited to 22 inches in depth and up to 8 shelves in height. The invention will be available in the following sizes, but not restricted to, 18"×4", 15"×4", or 12"×4". Other sizes would be available to meet demand.

The invention is used by selecting the length required for the existing case shelves, placing the invention on the existing shelf with the support base handle to the front of the display, filling the stock support base with available product, and locking the stock support panel into the base after the last package toward the back of the shelf is placed on the stock support base. When retail packages start to become depleted, the store personnel lifts the stock support base by the handle and pulls the base partially out of the display case. While resting the base on the front edge of the shelf, the base is tilted downward at approximately a 45 degree angle, allowing remaining product to slide to the front support handle. The back support panel is manually moved forward and locked into the corresponding holes behind the last package. The adjusted stock support system is then pushed back into and upon the existing display case shelf. The individual product is now moved to the front edge of the shelf for full view by customers. When stocking new product the same procedure is done with new product being placed in back of the old allowing proper rotation of product. A second option for pulling existing packages to the front, if spacing between shelves permits, is to reach over packages and pull back support panel forward, pushing existing packages to the front and locking support panel into respective holes without lifting stock support base off of shelves.

BRIEF DESCRIPTION OF THE DRAWINGS

Referring to the drawings.

DESCRIPTION OF THE PREFERRED EMBODIMENT

Figure 1:
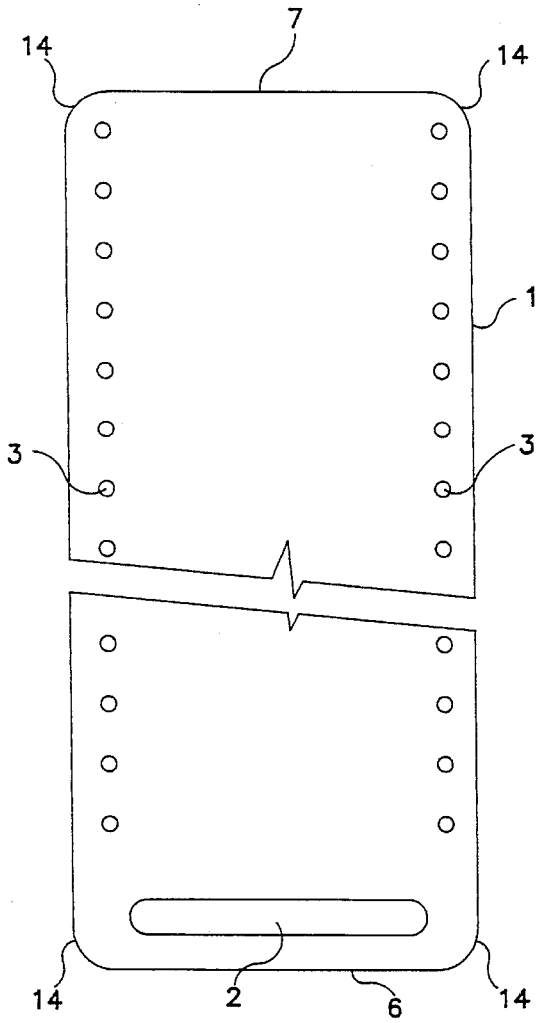
FIG. 1 is a top view showing an embodiment of a base and handle of a Stock Support System constructed in accordance with the present invention.

FIG. 1 shows a top view of an embodiment of a base 1 and a handle or member 2 of a stock support system constructed in accordance with the present invention. As can be seen in FIG. 1, handle 2 is coupled or molded to a first end 6 of base 1. As can also be seen in FIG. 1, base 1 is formed to include a plurality of opposing pairs of holes 3 along a longitudinal length of base 1. As can further be seen in FIG. 1, edges 14 of base 1 are generally rounded.

Figure 2:
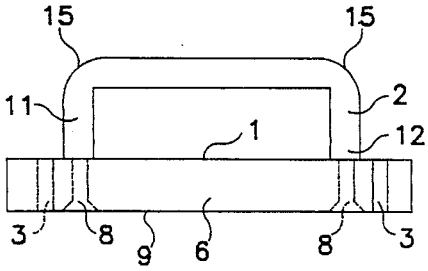
FIG. 2 is an end view of the base and handle shown in FIG. 1.

FIG. 2 shows an end view of base 1 and handle 2 shown in FIG. 1. As can be seen in FIG. 2, handle 2 is coupled to base 1 via a plurality of fasteners 8 disposed through bottom 9 of base 1 and into ends 11 and 12 of handle 2. As can also be seen in FIG. 2, edges 15 of handle 2 are generally rounded.

Figure 3:
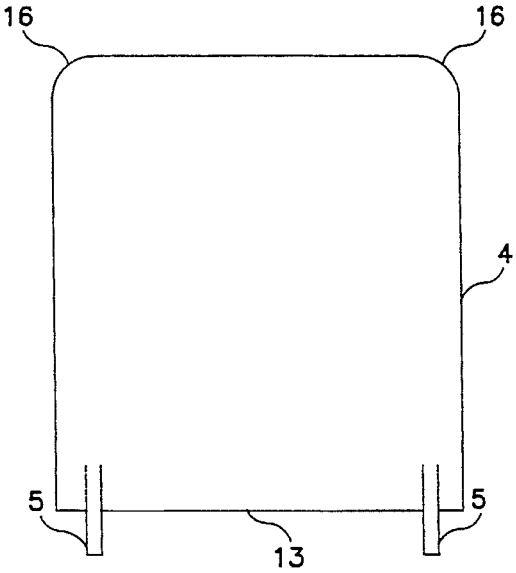
FIG. 3 is a side view of an embodiment of a panel and pins of a stock support system constructed in accordance with the present invention.

FIG. 3 is a side view of an embodiment of a panel 4 and pins 5 of a stock support system constructed in accordance with the present invention. As can be seen in FIG. 3, pins 5 are coupled to bottom 13 of panel 4. This may be achieved by disposing pins 5 in holes formed in bottom 13 of panel 4. As can also be seen in FIG. 3, edges 16 of panel 4 are generally rounded.

Figure 4:
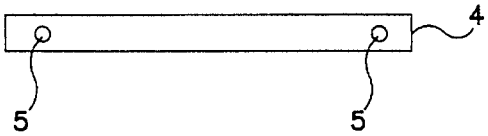
FIG. 4 is a bottom view of the panel and pins shown in FIG. 3.

FIG. 4 shows a bottom view of panel 4 and pins 5 shown in FIG. 3.

Figure 5:
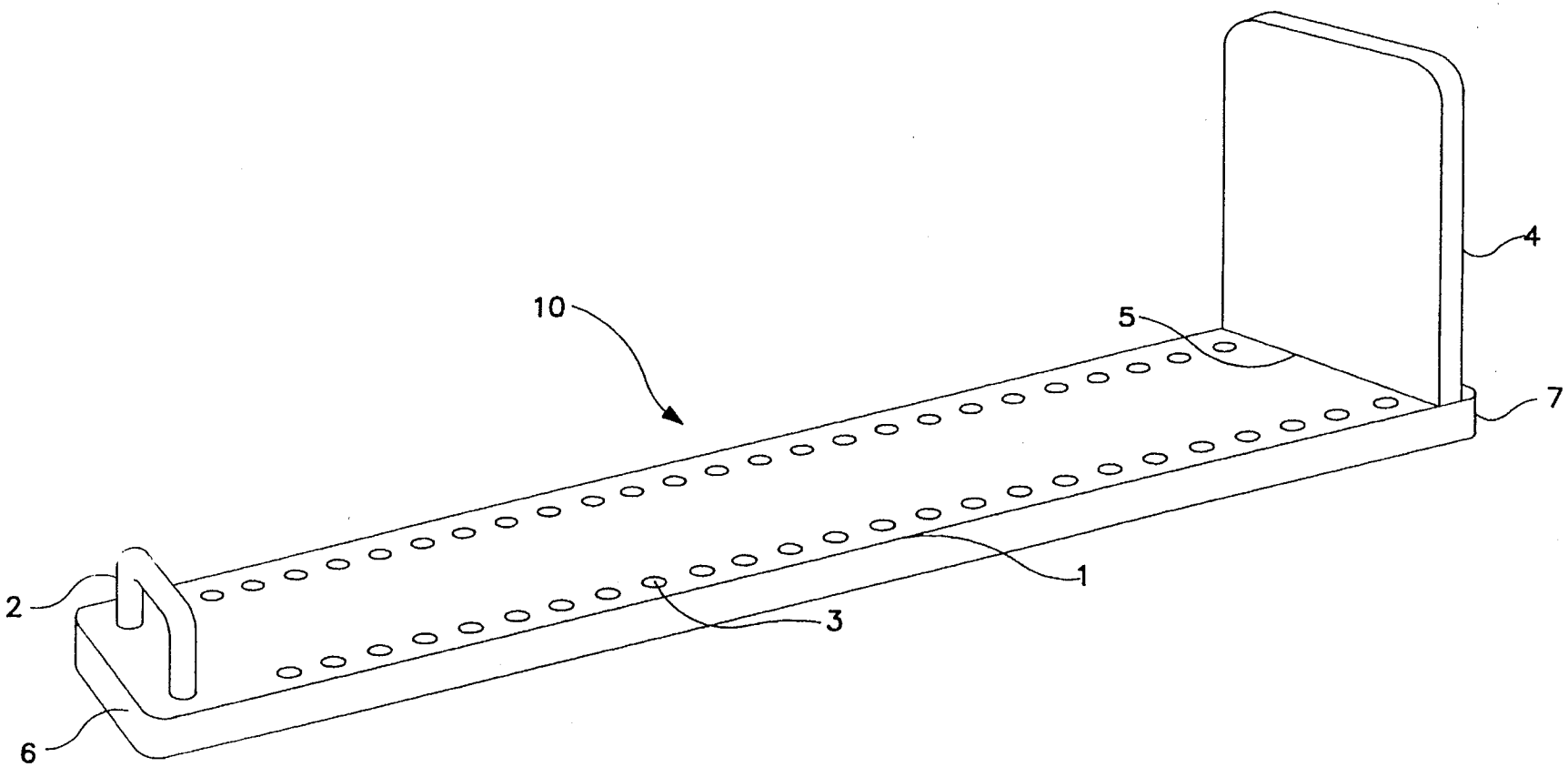
FIG. 5 is an assembled perspective view of a Stock Support System constructed in accordance with the present invention with a panel of the system in a last set of holes in a base of the system ready to receive new product.
Figure 6:
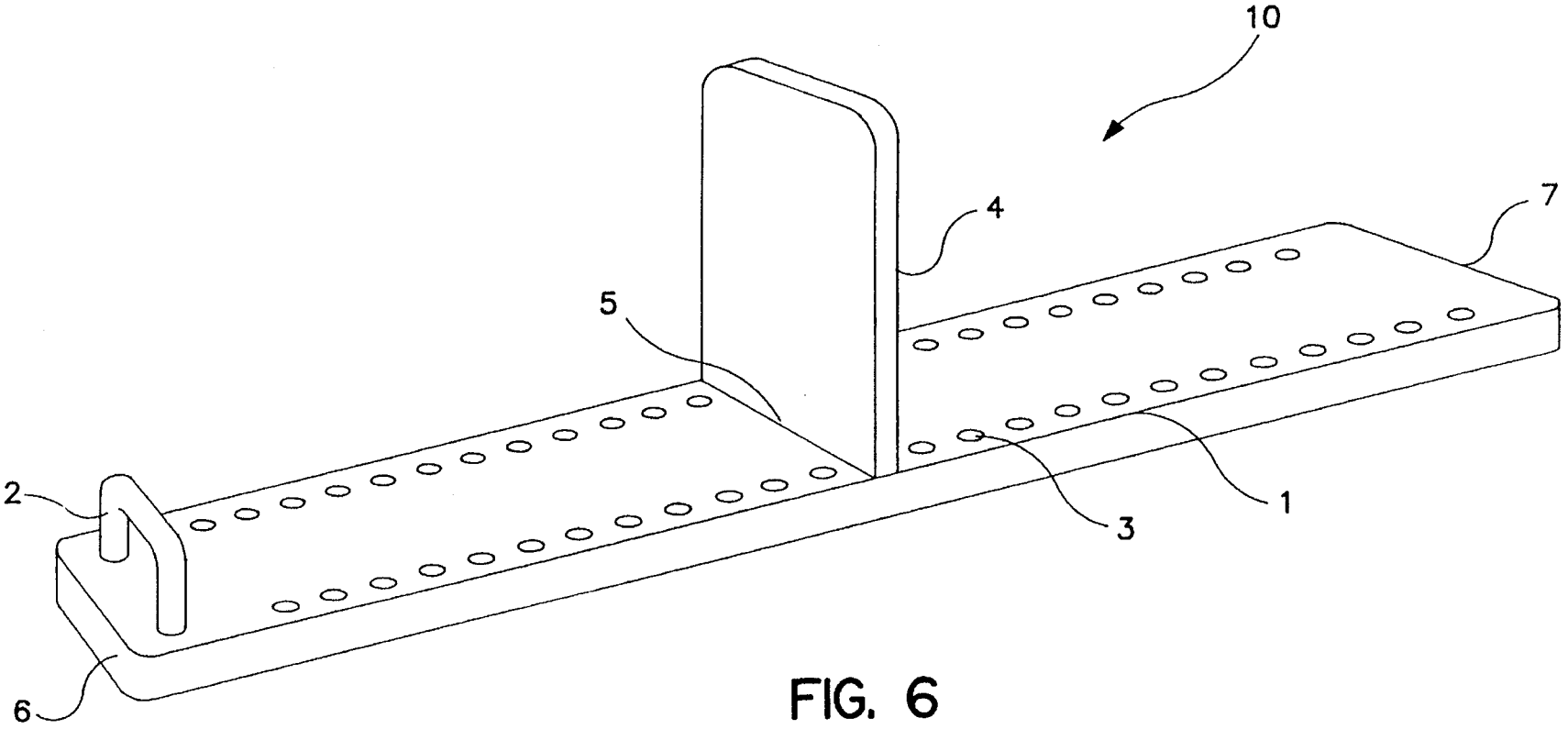
FIG. 6 is a perspective view of the Stock Support System shown in FIG. 5 with the panel of the system in approximately the middle of the base of the system.

Pins 5 of panel 4 may be selectively disposed in each of the opposing pairs of holes 3 to define an adjustable space between panel 4 and handle 2 in which product may be disposed on base 1, adjoining handle 2 and panel 4. Examples of the differing dimensions of the s..pace are illustrated by reference to FIGS. 5 and 6. As can be seen in FIGS. 5 and 6, handle 2 has a height selected to be sufficient to prevent product from falling forward and panel 4 has a height greater than the height of handle 2.

Base 1, handle 2, and panel 4 of system 10 may be made from polypropylene homopolymer via an injection mold single nozzle press. In addition, base 1, handle 2, and panel 4 may be made from structural foam, fiberglass, metal, plastic, wood, paper, cardboard, wood composites, resin composites, or molded plastic.

Referring to FIG. 5, system 10 is shown with pins 5 inserted in the last set of holes 3 in second end 7 of base 1 so that system 10 is ready to receive the maximum amount of packages for proper display. Panel 4 can be manually moved to the opposite or first end 6 of base 1 when the display is empty, to help avoid the empty look in relation to adjoining Stock Support Systems with packages in them.

Referring to FIG. 6, pins 5 coupled to panel 4 are inserted in holes 3 positioned in approximately the middle of base 1 ready to receive approximately half the amount of packages which Stock Support System 10 could hold, therefore keeping the packages to the front of the display shelf for maximum customer viewing.

I claim:

1. A method of displaying product on a shelf having a display end through the use of a stock support system including a base having a first end, a member fixed to the first end of the base and having a height sufficient to prevent product from falling forward of the member, and a panel, having a greater height than the height of the member, adjustably coupled to the base to define an adjustable space between the member and panel that receives the product, the method comprising the steps of:

placing the base on the shelf so that the first end of the base is adjacent the display end of the shelf;

moving the base on the shelf away from the display end after product has been removed from the base;

tilting the base on the shelf so that product remaining on the base advances toward the member to a position previously occupied by product that has been removed;

uncoupling the panel from the base; and recoupling the panel to the base so that the remaining product on the base adjoins and extends between the member and the panel.

2. A device for supporting product on a display shelf, comprising:

a base having a first end adjacent a front end of the shelf;

a member fixed to the first end of the base, the member having a first height sufficient to prevent product from falling forward of the member;

a panel having a height greater than the first height of the member; and structure adjustably coupling the panel to the base to define an adjustable space between the member and panel that receives the product, the dimensions of the space being selected so that the product adjoins and extends between the member and the panel;

wherein the coupling structure includes a plurality of opposing pairs of holes along a longitudinal length of the base and a pair of pins on the panel that are configured to be selectively disposable in each of the opposing pairs of holes to define the adjustable space.

3. The device of claim 2, wherein the base and panel have a generally rectangular shape.

4. The device of claim 2, wherein edges of the base, panel, and member are generally rounded.

5. The device of claim 2, wherein the base and panel are injection molded.

6. The device of claim 5, wherein the member is injection molded.

7. A device for supporting product on a display shelf, comprising:

a base having a first end adjacent a front end of the shelf;

a member fixed to the first end of the base, the member having a first height sufficient to prevent product from falling forward of the member;

a panel having a height greater than the first height of the member; and structure adjustably coupling the panel to the base to define an adjustable space between the member and panel that receives the product, the dimensions of the space being selected so that the product adjoins and extends between the member and the panel;

wherein the member is a generally U-shaped handle for manually moving the base on the shelf.

8. The device of claim 7, wherein the base and panel have a generally rectangular shape.

9. The device of claim 7, wherein edges of the base, panel, and member are generally rounded.

10. The device of claim 7, wherein the base and panel are injection molded.

11. The device of claim 10, wherein the member is injection molded.

* * * * *